US012196472B1

(12) United States Patent
Qiu

(10) Patent No.: US 12,196,472 B1
(45) Date of Patent: Jan. 14, 2025

(54) MOLD UNIT FOR PREPARING SLEEVE-MOLDED ICE BLOCK, MOLD ASSEMBLY, AND MOLD BOX

(71) Applicant: Zhengying Qiu, Ji'an (CN)

(72) Inventor: Zhengying Qiu, Ji'an (CN)

( * ) Notice: Subject to any disclaimer, the term of this patent is extended or adjusted under 35 U.S.C. 154(b) by 0 days.

(21) Appl. No.: 18/744,847

(22) Filed: Jun. 17, 2024

(30) Foreign Application Priority Data

Feb. 23, 2024 (CN) ..... 202430093680.0

(51) Int. Cl.
*F25C 1/04* (2018.01)
*F25C 1/243* (2018.01)
*F25C 1/25* (2018.01)

(52) U.S. Cl.
CPC ..... *F25C 1/04* (2013.01); *F25C 1/243* (2013.01); *F25C 1/25* (2018.01)

(58) Field of Classification Search
CPC ..... F25C 1/04; F25C 1/243; F25C 1/25
USPC ..... 62/344
See application file for complete search history.

(56) References Cited

U.S. PATENT DOCUMENTS 1,688,888 A * 10/1928 Spreen ..... F25C 1/24 211/74
1,894,545 A * 1/1933 Schoenfeld ..... A23G 9/506 426/139
1,894,897 A * 1/1933 Tinkham ..... F25C 1/24 249/127
2,166,560 A * 7/1939 Schmelzer ..... F25C 1/24 249/120
2,291,672 A * 8/1942 Youngberg ..... A01J 19/00 249/168
2,389,317 A * 11/1945 Kitto ..... F25C 1/24 249/70
2,415,451 A * 2/1947 Synnestvedt ..... F25C 1/24 62/135
2,505,947 A * 5/1950 DeBrocke ..... F25C 1/243 426/104
2,537,915 A * 1/1951 Roop ..... F25C 1/243 426/66
2,804,755 A * 9/1957 Ansel ..... F25C 1/24 249/121

(Continued)

FOREIGN PATENT DOCUMENTS

CN 114763952 A * 7/2022

OTHER PUBLICATIONS

Machine translation CN 114763952 A (Year: 2024).*

*Primary Examiner* — Eric S Ruppert
*Assistant Examiner* — Kirstin U Oswald
(74) *Attorney, Agent, or Firm* — Daniel M. Cohn; Howard M. Cohn

(57) ABSTRACT

A mold unit for preparing a sleeve-molded ice block is provided. The mold unit includes: an outer wall, configured as a ring-shaped enclosure to define an outer peripheral shape of the sleeve-molded ice block; an inner wall, configured as an inner column to define a through hole in the sleeve-molded ice block; a bottom wall, disposed between a bottom of the outer wall and a bottom of the inner wall and configured to define a bottom shape of the sleeve-molded ice block; an opening, disposed at a top of a ring-shaped space defined by the outer wall, the inner wall, and the bottom wall, wherein, liquid for preparing the sleeve-molded ice block is capable of being added through the opening.

19 Claims, 11 Drawing Sheets

(56) References Cited

U.S. PATENT DOCUMENTS

| | | | | | |
|---|---|---|---|---|---|
| 2,961,849 | A * | 11/1960 | Hitchcock | F25C 1/24 | D7/672 |
| 3,135,101 | A * | 6/1964 | Nigro | F25C 5/185 | D15/90 |
| 3,197,058 | A * | 7/1965 | Hale | B65D 21/046 | D9/755 |
| 3,576,113 | A * | 4/1971 | Swett | A47J 43/20 | D7/672 |
| 3,685,785 | A * | 8/1972 | Brown | F25C 1/243 | 249/70 |
| 4,081,122 | A * | 3/1978 | Hobson | F25C 1/24 | 206/521.1 |
| 4,432,529 | A * | 2/1984 | McMillan | F25C 1/243 | 249/129 |
| 5,250,315 | A * | 10/1993 | Loew | F25C 1/243 | 426/515 |
| 6,168,131 | B1 * | 1/2001 | Tabatabaie | F25C 1/24 | D15/90 |
| 11,965,687 | B1 * | 4/2024 | Wu | F25C 1/24 | |
| 2005/0151049 | A1 * | 7/2005 | Lion | F25C 1/24 | 249/127 |
| 2007/0262230 | A1 * | 11/2007 | McDermott | F25C 1/22 | 249/126 |
| 2009/0152438 | A1 * | 6/2009 | Chu | F25C 1/24 | 249/105 |
| 2016/0341461 | A1 * | 11/2016 | Williams | F25C 1/243 | |
| 2020/0018535 | A1 * | 1/2020 | Leal | F25C 1/243 | |
| 2021/0088267 | A1 * | 3/2021 | Nell | F25C 1/246 | |
| 2021/0381738 | A1 * | 12/2021 | Cran | F25C 1/25 | |

* cited by examiner

MOLD UNIT FOR PREPARING SLEEVE-MOLDED ICE BLOCK, MOLD ASSEMBLY, AND MOLD BOX

TECHNICAL FIELD

The present disclosure relates to the field of ice preparing devices, and in particular to a movable container that is configured to prepare ice.

BACKGROUND

An ice lattice is a tool that is commonly used to prepare ice. Generally, the ice lattice includes a box body and an ice lattice mold. The ice lattice mold is configured to hold water and is then placed in a freezing device to freeze the water in the ice lattice mold into ice blocks.

The ice products made by the ice lattice in the art are mostly solid ice blocks. When the ice is to be taken out of the mold, a plurality of ice lattices, which are made of silicone, are squeezed by twisting, enabling the ice blocks to be dislodged from the ice lattices. The ice blocks are poured out after being demolded. When the ice blocks are used in a cold beverage, the plurality of solid ice blocks are piled up together inside a cup. When a straw is to be used for drinking the beverage, the straw is often blocked by the piled-up ice blocks and cannot be easily inserted to reach a bottom of the cup. In addition, the solid ice blocks inside the cup can generate noise when the cup is shaken. Due to the ice blocks being piled up, the entire cup is not evenly cooled from a top to the bottom.

The Chinese patent No. CN219415336U discloses an ice-making box, including a box body, a box lid and at least one ice lattice plate. The ice lattice plate is arranged with a plurality of ice lattices. When the ice blocks are being taken out of the lattices, the ice lattice plate is flipped 180°, the ice lattice plate is placed into the box body by enabling openings of the ice lattices to face downward. Two ends of the ice lattice plate are placed on a left bump and a right bump respectively. Subsequently, the box lid covers the ice lattice plate, the bumps are pressed to the ice lattice plate, the box lid is pressed, and all forces are focused on the bumps. Diagonally-distributed posts act on the ice lattice plate. A left rear corner of the ice lattice plate twists and deforms along an upper surface of the left bump downwardly due to the action of one of the posts. A right rear corner of the ice lattice plate twists and deforms downwardly along an upper surface of the left bump due to the action of another of the posts. The ice lattice plate is twisted and deformed so as to dislodge ice blocks from the ice lattices. The advantage of the ice box is that a larger number of ice blocks can be produced at one time, and the ice blocks can be easily removed from the ice lattice plate. A disadvantage of the above disclosure is that the produced ice block has a solid structure.

SUMMARY OF THE DISCLOSURE

The present disclosure provides a mold unit, a mold assembly, and a mold box for preparing sleeve-molded ice blocks. A plurality of sleeve-molded ice blocks having different sizes can be prepared and are suitable to be placed in a cold drink cup. An outer circumference of the ice blocks can be fit inside the cup, and therefore, noise due to collision is reduced. The sleeve-molded ice blocks enable a straw to be inserted through through holes of the ice blocks to reach a bottom of the cup. The plurality of ice blocks are laminated in the cup. In this way, the cup is cooled evenly from a top to the bottom thereof, the ice blocks are melt at a reduced speed, the cold drink can be maintained at a lower temperature for a long time, improving the usage experience.

The present disclosure provides a mold unit for preparing a sleeve-molded ice block. The mold unit includes: an outer wall, configured as a ring-shaped enclosure to define an outer peripheral shape of the sleeve-molded ice block; an inner wall, configured as an inner column to define a through hole in the sleeve-molded ice block; a bottom wall, disposed between a bottom of the outer wall and a bottom of the inner wall and configured to define a bottom shape of the sleeve-molded ice block; an opening, disposed at a top of a ring-shaped space defined by the outer wall, the inner wall, and the bottom wall, wherein, liquid for preparing the sleeve-molded ice block is capable of being added through the opening.

In some embodiments, the mold unit further includes a water plate arranged at a top of the outer wall. The water plate is substantially parallel to the bottom wall and is configured to prevent the top of the outer wall from being deformed.

In some embodiments, the mold unit further includes a top plate arranged at a top of the inner wall. The inner column is hollow having an opening facing downwardly, and the top plate is arranged to prevent the top of the inner wall from being deformed.

In some embodiments, a plurality of reinforcing ribs are arranged at an interior of the hollow inner column, and each of plurality of reinforcing ribs includes: a radial rib, extending along a rear of the top plate; and a generatrix rib, connecting with the radial rib and extending along a rear of the inner wall.

In some embodiments, a pull-out inclination is formed between the outer wall and the inner wall that define the ring-shaped space, the pull-out inclination is configured to enable the sleeve-molded ice block to be easily taken out of the mold unit.

In some embodiments, each of an inner contour line and an outer contour line of a cross section of the ring-shaped space is circular or polygonal.

In some embodiments, the outer wall of the ring-shaped space, the inner wall of the ring-shaped space, the bottom wall of the ring-shaped space, the water plate, the top plate, and the plurality of reinforcing ribs are configured as a one-piece and integral structure and are made of silicone.

In some embodiments, a reinforcing ring is arranged at connection between a rear of the water plate and the outer wall; and the reinforcing ring is configured to improve resistance of an outer edge of the opening of the mold unit against deformation.

Beneficial effects of the mold unit for preparing the sleeve-molded ice blocks in the present disclosure include the following.

1. In the present disclosure, the ring-shaped enclosing outer wall, the columnar inner wall, and the bottom wall cooperatively define a ring-shaped space. The ring-shaped space is configured to receive liquid for making the ice. When the ice is to be taken out of the mold unit, the sleeve-typed mold unit is pressed to be physically deformed, enabling the ice in the ring-shaped space of the mold unit to be dislodged, and the sleeve-molded ice blocks are obtained.

2. The mold unit for preparing the sleeve-molded ice blocks of the present disclosure has a simpler structure compared to ice-preparing molds in the art. Fewer operations are performed to take out the ice blocks, and less time is consumed, and therefore, an efficiency of taking the ice blocks is improved.

The present disclosure provides a mold assembly for preparing a sleeve-molded ice block. The mold assembly includes: a plurality of mold units as described in the above. Axes of the plurality of mold units are substantially parallel to each other. Water plates of all of the plurality of mold units are connected to form a one-piece structure and are located on a same horizontal plane.

In some embodiments, the plurality of mold units comprises a small-size mold unit, a medium-size mold unit, and a large-size mold unit; a maximum size of a bottom of a ring-shaped space of the small-size mold unit is larger than a minimum size of a top of the ring-shaped space of the medium-sized mold unit; and a maximum size of a bottom of the ring-shaped space of the medium-sized mold unit is larger than a minimum size of a top of the ring-shaped space of the large-sized mold unit.

In some embodiments, a front side of the water plates, which are connected to each other to form the one-piece structure, defines a communication slot between every two adjacent mold units of the plurality of mold units; and the communication slot is configured to enable liquid for preparing the ice in one ring-shaped space of one of the plurality of mold units to flow to another ring-shaped space of adjacent one of the plurality of mold units for compensation.

In some embodiments, a ring-shaped protruding edge is arranged at a periphery of a front side of the water plates and extends upwardly and downwardly, the ring-shaped protruding edge is configured to increase resistance of an outer edge of the water plates of the mold assembly against deformation.

In some embodiments, the mold assembly further includes an upper lid. The upper cover is configured to cover a top of the water plates to prevent foreign objects from falling into the ring-shaped spaces of the mold assembly.

In some embodiments, a flexible connection strip is arranged between an edge of the upper lid and an edge of the water plates to facilitate the upper lid to cover or to be released from the water plates.

Beneficial effects of the mold assembly for preparing the sleeve-molded ice blocks in the present disclosure include the following.

The mold assembly in the present disclosure includes a small sized mold unit, a medium sized mold unit, and a large sized mold unit. Therefore, sleeve-molded ice blocks in different sizes are prepared and are particularly suitable to be used in a Stanley cup. The circumferential shape of the ice block fits the interior of the cup, and therefore, noise due to collision is reduced. Through holes in the sleeve-molded ice blocks enables the straw to be inserted therethrough to reach the bottom of the cup. The ice blocks are laminated inside the cup, and therefore, the cup is evenly cooled from the top to the bottom, the ice blocks are melted at a lower speed, and the cold drink is maintained cold for a longer period of time.

The present disclosure provides a mold box for preparing a sleeve-molded ice block. The mold box includes: a box body, configured to store the mold assembly as described in the above. A horizontal box bottom and a ring-shaped side wall of the box body are connected to each other to form a vessel that does not leak any liquid. The bottom wall of the mold unit of the mold assembly is placed on the horizontal box bottom of the box body. A shape of an opening of the box body is the same as a shape of the water plates that are connected to each other to form the one-piece structure.

In some embodiments, a plane on which an opening of the box body is located is substantially parallel to a plane on which the one-piece structured water plates is located.

In some embodiments, mold box further includes: a box lid, configured to seal the mold assembly to an interior of the box body to prevent a foreign object from falling into the mold box.

In some embodiments, a ring-shaped step edge is recessed inwardly and arranged on a top of the ring-shaped side wall of the box body; the ring-shaped edge of the box lid is double layered and extends downwardly to form a ring-shaped snapping slot; the ring-shaped snapping slot of the box lid snaps two sides of the ring-shaped step edge of the box body to achieve seamless snapping between the box lid and the box body.

In some embodiments, a plurality of outer snapping strips are arranged on and protruding outwardly from an outer side of the ring-shaped step edge of the box body; a plurality of inner snap strips are arranged on and protruding inwardly an inner side of an outer wall of the ring-shaped snapping slot of the box lid; circumferential distributed locations of the plurality of outer snapping strips are the same as circumferential distributed locations of the plurality of inner snapping strips.

In some embodiments, a gripping plate, in a shape of an approximate brim, is arranged at and protruding outwardly from a lower end of the outer wall of the downwardly-extending ring-shaped snapping slot of a short side of the box lid, the gripping plate is configured to facilitate the box lid to be opened.

Beneficial effects of the mold box for preparing the sleeve-molded ice blocks in the present disclosure include the following.

For the mold box in the present disclosure, the mold assembly is received in the cavity of the container of the box body, the box lid seals the mold assembly to the opening of the box body, preventing dust and other foreign matter from falling into the mold box. Therefore, hygiene of the ice product is ensured, the mold box has an overall simple configuration and can be operated easily.

BRIEF DESCRIPTION OF THE DRAWINGS

In order to more clearly illustrate technical solutions in the embodiments of the present disclosure or in the art, the accompanying drawings to be used for describing the embodiments of the present disclosure or in the art will be briefly introduced below. Obviously, the accompanying drawings in the following description show only some of the embodiments of the present disclosure. Any ordinary skilled person in the art may obtain other drawings based on the accompanying drawings without making any creative work.

Figure 1:
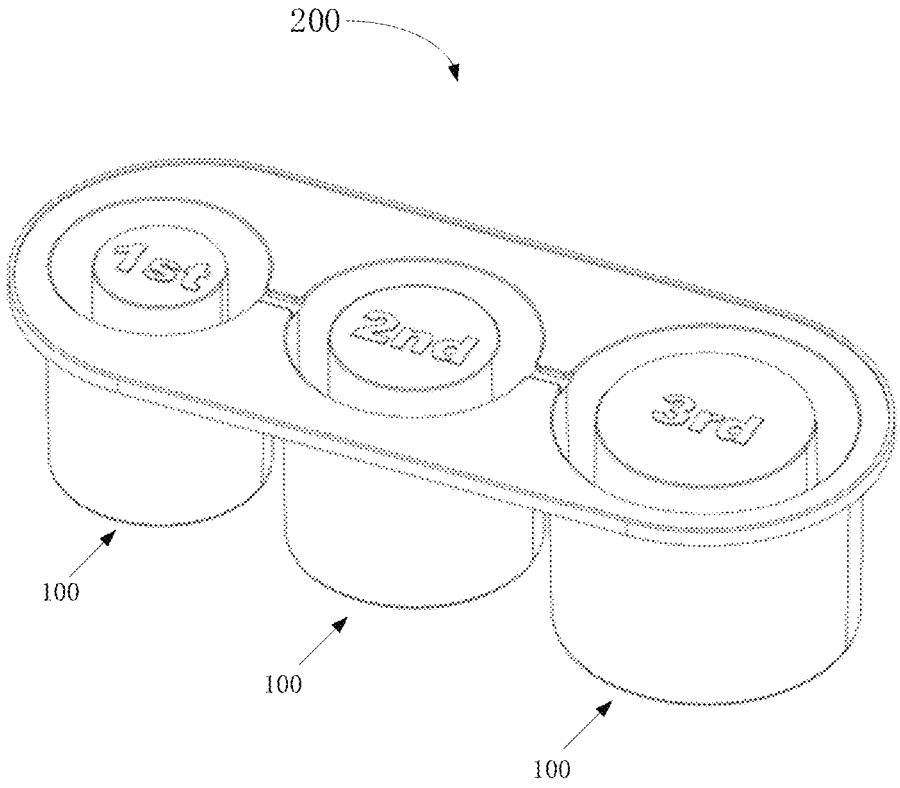
FIG. 1 is a structural schematic view of a mold assembly for preparing sleeve-molded ice blocks according to an Embodiment 1 of the present disclosure.
Figure 2:
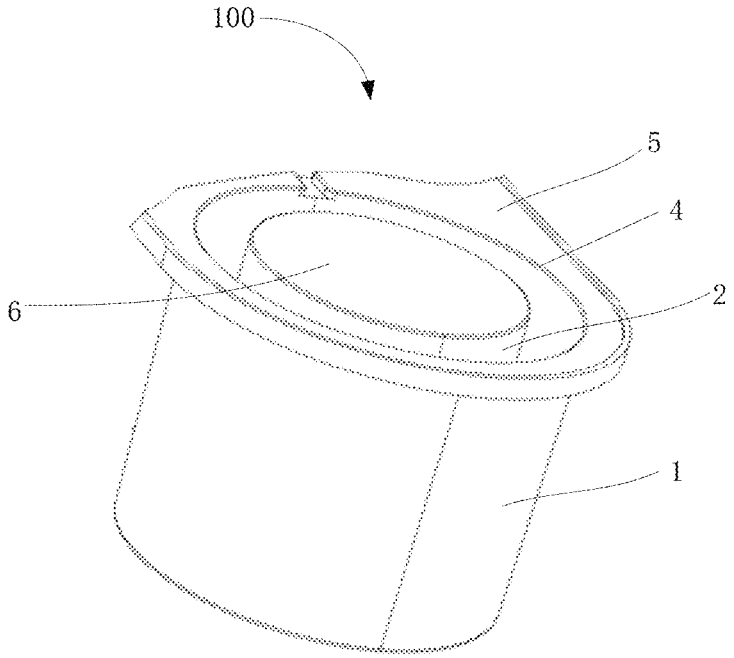
FIG. 2 is a structural schematic view of a mold unit of the mold assembly for preparing sleeve-molded ice blocks according to the Embodiment 1 of the present disclosure.
Figure 3:
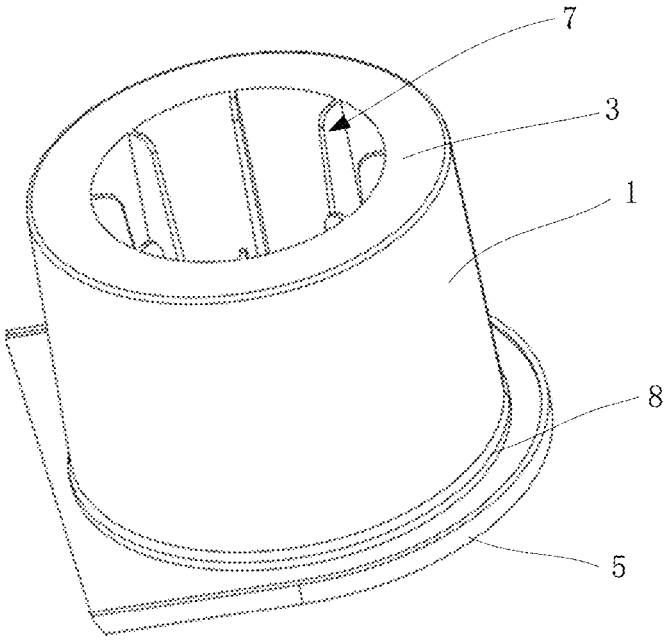
FIG. 3 is a structural schematic view of the mold unit, being viewed from another viewing angle, of the mold assembly for preparing sleeve-molded ice blocks according to the Embodiment 1 of the present disclosure.
Figure 4:
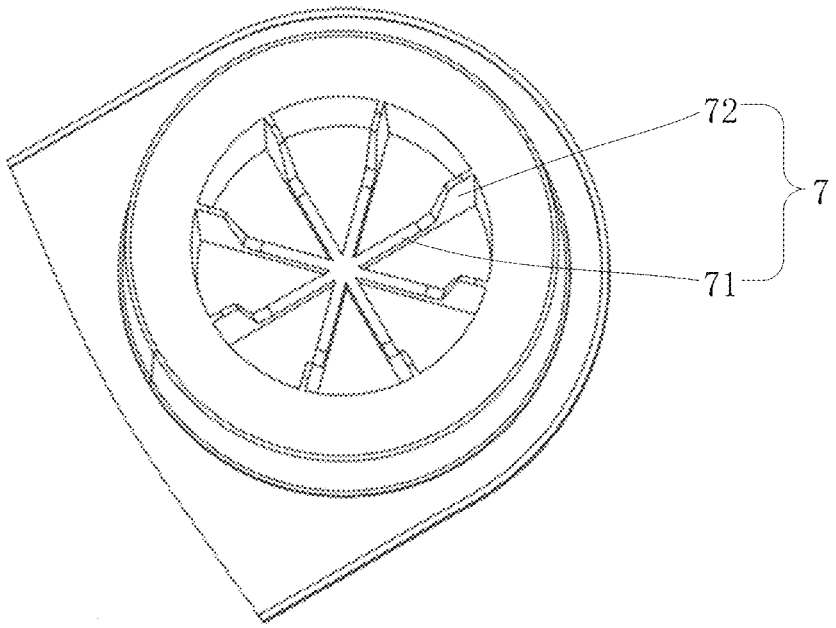
FIG. 4 is a structural schematic view of the mold unit, being viewed from still another viewing angle, of the mold assembly for preparing sleeve-molded ice blocks according to the Embodiment 1 of the present disclosure.

Reference numerals in the drawings: mold unit 100; outer wall 1; inner wall 2; bottom wall 3; opening 4; water plate 5; top plate 6; reinforcing rib 7; radial rib 71; generatrix rib 72; reinforcing ring 8; ring-shaped space 9; Contour line 91; outer contour line 911; inner contour line 912; Mold assembly 200; small-sized mold unit 20; medium-sized mold unit 30; large-sized mold unit 40; communication slot 51; ring-shaped protruding edge 52; over-flow hole 53; indication block 60; upper lid 70; flexible connection strip 701; box body 301; horizontal box bottom 301*a*; ring-shaped side wall 301*b*; ring-shaped step edge 301*c*; outer snapping strip 301*d*; box lid 302; ring-shaped snapping slot 302*a*; inner snapping strip 302*b*; gripping plate 302*c*; wavy pattern 302*d*.

DETAILED DESCRIPTION

Technical solutions in embodiments of the present disclosure will be described clearly and completely by referring to the accompanying drawings of the embodiments of the present disclosure. Apparently, the described embodiments are a part of but not all of the embodiments of the present disclosure. All other embodiments, which are obtained by any ordinary skilled person in the art based on the embodiments in the present disclosure without making creative work, shall fall within the scope of the present disclosure.

Embodiment 1

As shown in FIG. 1, in the present disclosure, the mold assembly 200 for preparing sleeve-molded ice blocks includes a plurality of mold units 100. In some embodiments, 3 mold units 100 are arranged.

As shown in FIGS. 2, 3, 4, 5 and 6, each of the plurality of mold units 100 for preparing the sleeve-molded ice blocks includes an outer wall 1, an inner wall 2, and a bottom wall 3. The outer wall 1 is a ring-shaped enclosure and defines a peripheral shape of the sleeve-molded ice block. The inner wall 2 is configured as an inner column in shape. The inner wall 2 is configured to form a through hole in the sleeve-molded ice block. The bottom wall 3 is disposed between a bottom of the outer wall 1 and a bottom of the inner wall 2 to define a bottom shape of the sleeve-molded ice block. The outer wall 1, the inner wall 2, and the bottom wall 3 cooperatively enclose a ring-shaped space of the mold unit. An upper part of the ring-shaped space 9 has an opening 4 through which liquid is added for making the ice block.

During preparing the ice, the liquid for making the ice, such as water or beverage, is input into and stored in the ring-shaped space 9 of the mold unit 100 through the opening 4. The mold unit 100 is subsequently placed in a refrigerating device, such as a refrigerator or a freezer, to prepare the ice at a low temperature. The liquid for making the ice stored in the ring-shaped space 9 of the mold unit 100 condenses at the low temperature. When the ice is to be taken, the mold unit 100 is removed from the refrigerating device, the mold unit 100 is squeezed and twisted to be deformed. A gap is generated between the ice block in the ring-shaped space 9 and the outer wall 1, the inner wall 2, and the bottom wall 3. In this way, the ice block is removed from the opening 4 of the ring-shaped space 9 of the mold unit 100, and the sleeve-molded ice block is obtained. The sleeve-molded ice block has a through hole that extends through the ice block in an up-down direction.

Figure 5:
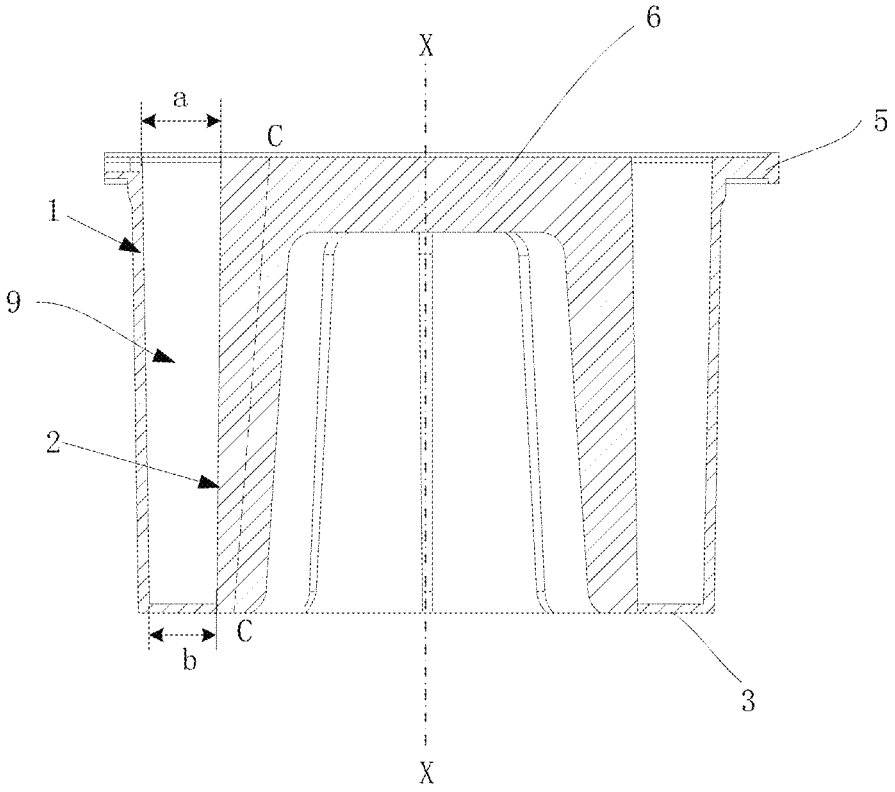
FIG. 5 is a longitudinal cross-sectional view of the mold unit of the mold assembly for preparing sleeve-molded ice blocks according to the Embodiment 1 of the present disclosure.
Figure 6:
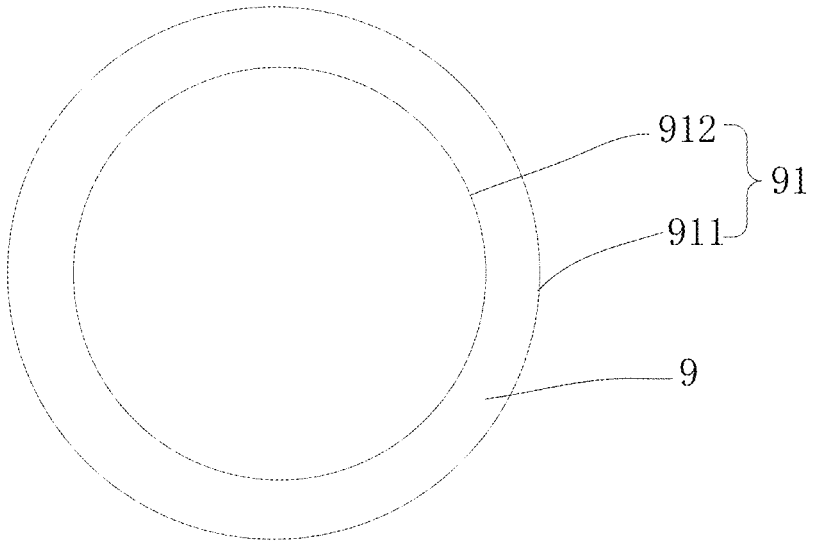
FIG. 6 shows an inner contour line and an outer contour line of a cross section of a ring-shaped space of the mold unit of the mold assembly for preparing sleeve-molded ice blocks according to the Embodiment 1 of the present disclosure.

In order to enable the sleeve-molded ice block to be easily removed from the ring-shaped space 9 of the mold unit 100, a pull-out inclination is formed between the outer wall 1 and the inner wall 2 that cooperatively define the ring-shaped space 9. Specifically, both the outer wall 1 and the inner wall 2 of the ring-shaped space 9 are inclined, and therefore, a cross-sectional area of the ring-shaped space 9 gradually decreases from the opening 4 of the ring-shaped space 9 toward the bottom wall 3. As shown in FIG. 5, a is a distance between the outer wall 1 and the inner wall 2 at an upper portion of the ring-shaped space 9, b is a distance between the outer wall 1 and the inner wall 2 at a lower portion of the ring-shaped space 9, and a>b.

In the present embodiment, an inner contour line and an outer contour line 91 of a cross section of the ring-shaped space 9 of the mold unit 100 are both circular. Specifically, the outer contour line 911 is circular; and the inner contour line 912 corresponding to the outer contour line 911 is circular. A diameter of the outer contour line 911 is larger than a diameter of the inner contour line 912. In this way, the sleeve-molded mold unit 100 is formed.

When the sleeve-molded ice blocks are to be taken out of the mold unit 100, the ring-shaped space 9 of the mold unit 100 is inverted to enable the opening 4 of the ring-shaped space 9 to face downwardly and enable the bottom wall 3 of the mold unit 100 to face upwardly. Since the pull-out inclination is formed between the outer wall 1 and the inner wall 2 of the ring-shaped space 9, the outer wall 1 and the inner wall 2 do not apply any obstruction to a side wall of the sleeve-molded ice block formed by condensation of the liquid in the ring-shaped space 9. The sleeve-molded ice block can be smoothly removed from the ring-shaped space 9 of the mold unit 100, and therefore, the ice is easily removed.

In the present embodiment, a water plate 5 is arranged at a top of the outer wall 1 of the mold unit 100. The water plate 5 is substantially parallel to the bottom wall 3. The water plate 5 prevents the top of the outer wall 1 from being deformed. A top plate 6 is arranged at a top of the inner wall 2. The inner column of the inner wall 2 is hollow having an opening facing downwardly. In this way, the top of the inner wall 2 is prevented from being deformed. Inside the hollow inner column, a plurality of reinforcing ribs 7 are arranged. The plurality of reinforcing ribs 7, the inner wall 2, and the top plate 6 are configured as a one-piece and integral structure. Each reinforcing rib 7 includes a radial rib 71 and a generatrix rib 72. The radial rib 71 extends along a rear of the top plate 6. The generatrix rib 72 is connected to the radial rib 71 and extends along a rear of the inner wall 2. Specifically, the generatrix bar 72 extends along a direction of generatrix lines C-C of the inner wall 2. The reinforcing rib 7 is configured to prevent the inner column of the inner wall 2 from being deformed. A reinforcing ring 8 is arranged at connection between a rear of the water plate 5 and the outer wall 1. The reinforcing ring 8 improves resistance of an outer edge of the opening 4 of the mold unit 100 against deformation.

In the present embodiment, the outer wall 1 of the ring-shaped space 9, the inner wall 2 of the ring-shaped space 9, the bottom wall 3 of the ring-shaped space 9, the water plate 5, the top plate 6 and the reinforcement rib 7 of the mold unit 100 are configured as a one-piece and integral structure and is made of silicone. The silicone is insoluble in water, non-toxic and tasteless, and chemically stable. The silicone does not react with any substance other than strong alkali and hydrofluoric acid. The silicone is thermally stable and chemically stable and has high mechanical strength. Therefore, the silicone can be used as a material for making the mold unit for preparing the sleeve-molded ice blocks.

Figure 7:
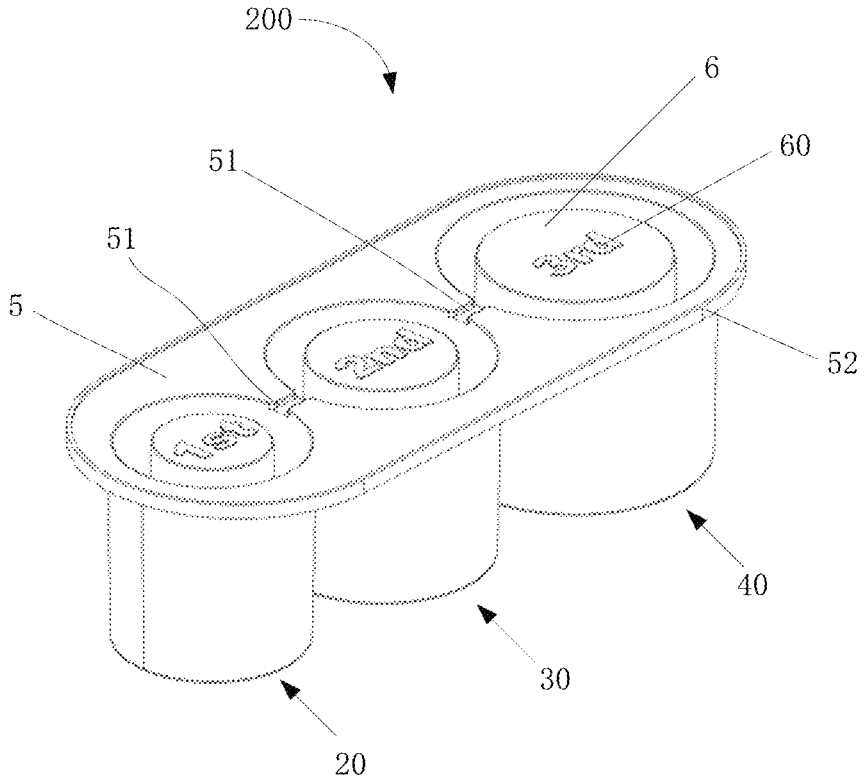
FIG. 7 is a structural schematic view of the mold assembly, being viewed from another viewing angle, for preparing sleeve-molded ice blocks according to the Embodiment 1 of the present disclosure.
Figure 8:
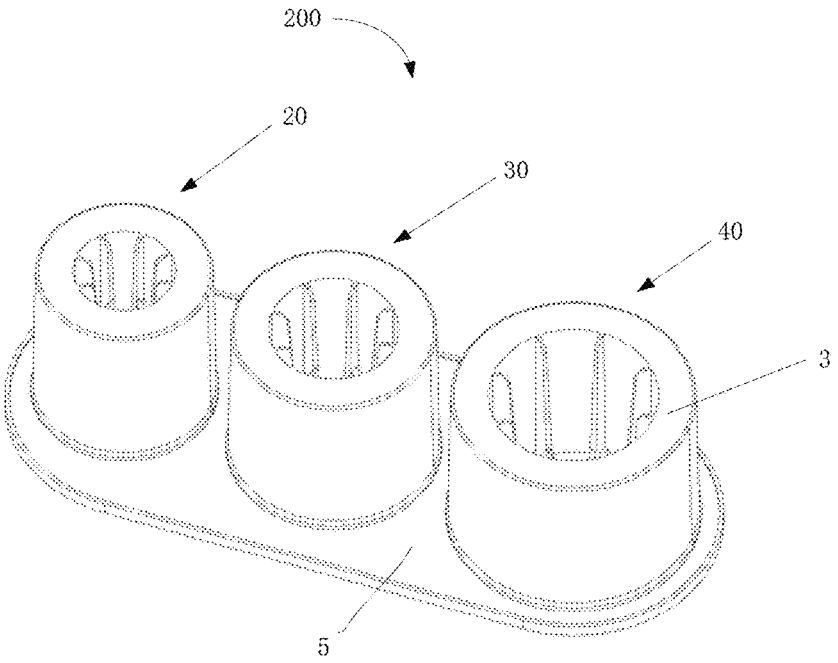
FIG. 8 is a structural schematic view of the mold assembly, being viewed from still another viewing angle, for preparing sleeve-molded ice blocks according to the Embodiment 1 of the present disclosure.
Figure 9:
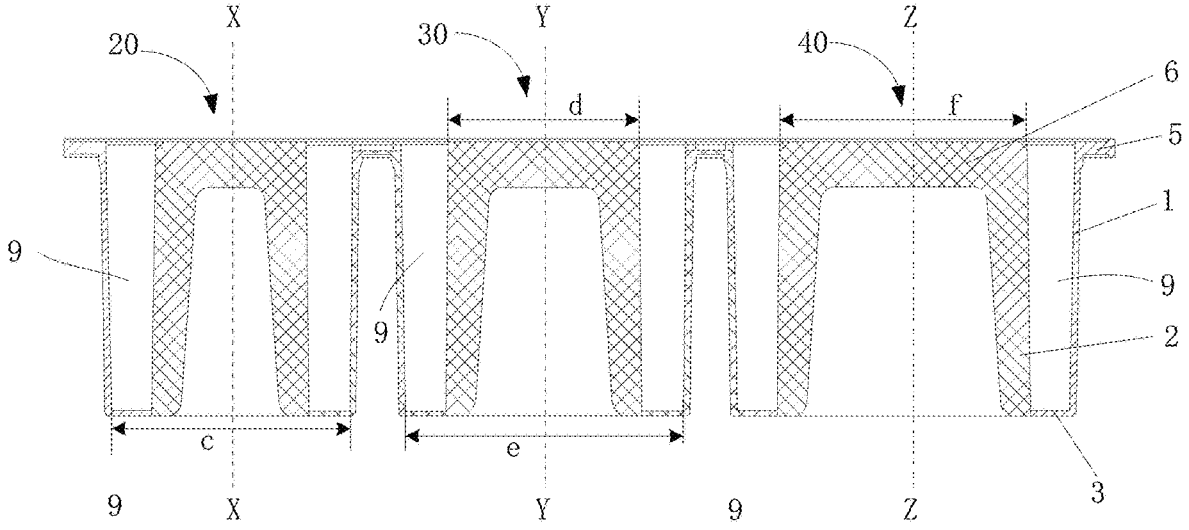
FIG. 9 is a longitudinal cross-sectional view of the mold assembly for preparing sleeve-molded ice blocks according to the Embodiment 1 of the present disclosure.
Figure 10:
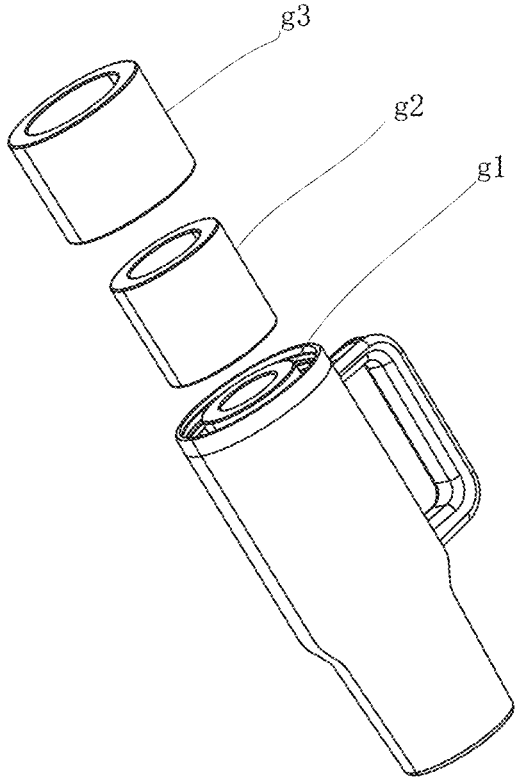
FIG. 10 shows an in-use state of the ice blocks made by the mold assembly for preparing sleeve-molded ice blocks according to the Embodiment 1 of the present disclosure.

As shown in FIGS. 7, 8 and 9, in the present embodiment, the three mold units 100 in the mold assembly 200 are a small-sized mold unit 20, a medium-sized mold unit 30, and a large-sized mold unit 40. The three mold units 100 are arranged in a straight line. An axis X-X of the small-sized mold unit 20, an axis Y-Y of the medium-sized mold unit 30, and an axis Z-Z of the large-sized mold unit 40 are substantially parallel to each other. Water plates 5 of all of the plurality of mold units 100 are arranged on a same horizontal plane and are connected to each other. A maximum size c of the bottom of the ring-shaped space 9 of the small-sized mold unit 20 is larger than a minimum size d of the top of the ring-shaped space 9 of the medium-sized mold unit 30. A maximum dimension e of the bottom of the ring-shaped space 9 of the medium-sized mold unit 30 is larger than a minimum dimension f of the top of the ring-shaped space 9 of the large-sized mold unit 40. That is, c>d,e>f. Since the minimum sizes of the ring-shaped spaces 9 of the three mold units 100 are configured as above, sleeve-molded ice blocks having different radial sizes can be made by the small-sized mold unit, the medium-sized mold unit, and the large-sized mold unit, as shown in FIG. 10, a small-sized sleeve-molded ice block g1, a medium-sized sleeve-molded ice block g2, and a large-sized sleeve-molded ice block g3 are obtained.

A front side of the water plates 5, which are connected to each other, defines communication slots 51 between every two adjacent mold units 100. The communication slots 51 are communicated with the ring-shaped space 9. In this way, liquid for preparing the ice in one ring-shaped space 9 can flow to another ring-shaped spaces 9 adjacent thereto for compensation. When the liquid is added to the ring-shaped spaces 9 of the mold assembly 200, the liquid in the ring-shaped spaces 9 in the three mold units 100 remain at a same level. Therefore, when preparing the ice blocks, the sleeve-molded ice blocks made in the ring-shaped spaces 9 of the three mold units 100 have a substantially the same height. A ring-shaped protruding edge 52 is arranged at a periphery of the front side of the water plate 5 and extends upwardly and downwardly at the same time. The ring-shaped protruding edge 52 is configured to increase resistance of the outer edge of the water plate 5 of the mold assembly against deformation.

For the mold assembly 200 of the present embodiment, an upper surface of the top plate 6 of the mold unit 100 is arranged with an indication block 60 to identify the mold unit 100 being the small size, the medium size, or the large size. The small-sized mold unit 20, the medium-sized mold unit 30, and the large-sized mold unit 40 of the mold assembly 200 are labeled with the indication block 60 to differentiate sizes of the prepared sleeve-molded ice blocks. Therefore, differentiation can be performed easily, sizes of the prepared sleeve-molded ice blocks may not be confused. The indication block 60 may be a number, a letter, or a pattern, as long as the size of the prepared sleeve-molded ice block can be determined.

In order to prepare the sleeve-molded ice blocks, liquid for preparing the ice, such as water, beverage, and so on, is added to the ring-shaped spaces 9 of the small-sized mold unit 20, the medium-sized mold unit 30, and the large-sized mold unit 40. Subsequently, the mold assembly 200 is placed in the refrigerating device, such as a refrigerator or a freezer, to prepare ice at a low temperature. The liquid for preparing the ice in the ring-shaped space 9 of the mold assembly 200 condenses at the low temperature. When the ice blocks are to be taken, the mold assembly 200 is removed from the refrigerating device, the opening 4 of the mold unit 100 is enabled to face downwardly, the mold unit 100 is compressed and twisted, causing the ring-shaped space 9 of the mold unit 100 to be deformed. In this way, the gap is generated between the ice block in the ring-shaped space 9 and the outer wall 1, the inner wall 2, and the bottom wall 3, and the ice blocks are released from the ring-shaped spaces 9 of the mold assembly 200, the small-sized sleeve-molded ice block, the medium-sized sleeve-molded ice block, and the large-sized sleeve-molded ice block are obtained, and each ice block has a through hole.

In the present embodiment, the small-sized sleeve-molded ice block g1, the medium-sized sleeve-molded ice block g2, and the large-sized sleeve-molded ice block g3, which are prepared by the mold assembly 200, are sequentially laminated from a bottom of the Stanley cup to an opening of the Stanley cup (as shown in FIG. 10). The Stanley cup is a deep beverage cup having a handle. A cross-sectional area of the Stanley cup gradually increases from the bottom to the opening thereof. Ice blocks are usually placed in the Stanley cup, and the straw is inserted in the Stanley cup for drinking. In the Stanley cup, an outer periphery of the sleeve-molded ice blocks matches an inner wall of the Stanley cup, noise due to collision is reduced. The through hole in the sleeve-molded ice block allows the straw to be inserted therethrough to reach the bottom of the Stanley cup. The sleeve-molded ice blocks are laminated in the Stanley cup, and therefore, the Stanley cup is cooled evenly from the top to the bottom. The ice blocks are melted at a lower speed, and the cold drink is maintained cold for a longer period of time Embodiment 2

Figure 11:
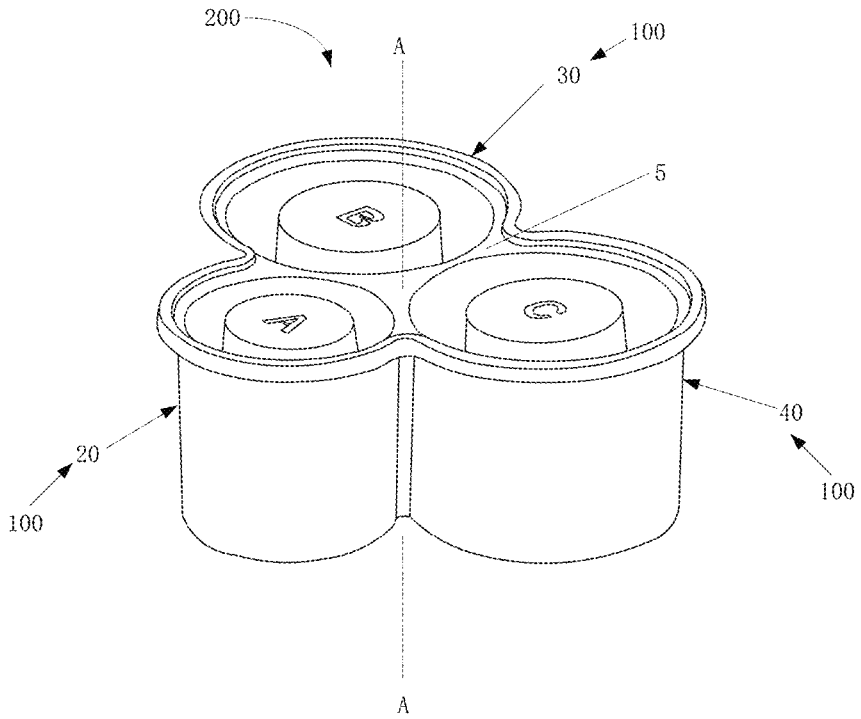
FIG. 11 is a structural schematic view of the mold assembly for preparing sleeve-molded ice blocks according to an Embodiment 2 of the present disclosure.

As shown in FIG. 11, in the present embodiment, an arrangement of the three mold units 100 of the mold assembly 200 for preparing the sleeve-molded ice blocks is different from that in the Embodiment 1. In the present embodiment, the small-sized mold unit 20, the medium-sized mold unit 30 and the large-sized mold unit 40 are arranged around a central axis A-A of the mold assembly 200. A periphery of the water plate 5 of the mold unit 100 is a curved edge.

Embodiment 3

Figure 12:
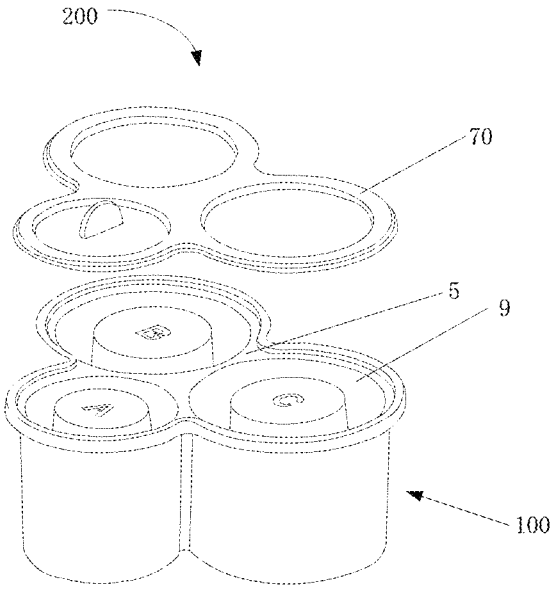
FIG. 12 is a structural schematic view of a mold assembly for preparing sleeve-molded ice blocks according to an Embodiment 3 of the present disclosure.

As shown in FIG. 12, in the present embodiment, the mold assembly 200 for preparing the sleeve-molded ice blocks further includes an upper lid 70. The upper lid 70 sealingly covers a top of the water plate 5 of the mold unit 100. By taking the upper lid 70 to cover the top of the mold unit 100, foreign objects are prevented from falling into the ring-shaped spaces 9 of the mold assembly 200.

Embodiment 4

Figure 13:
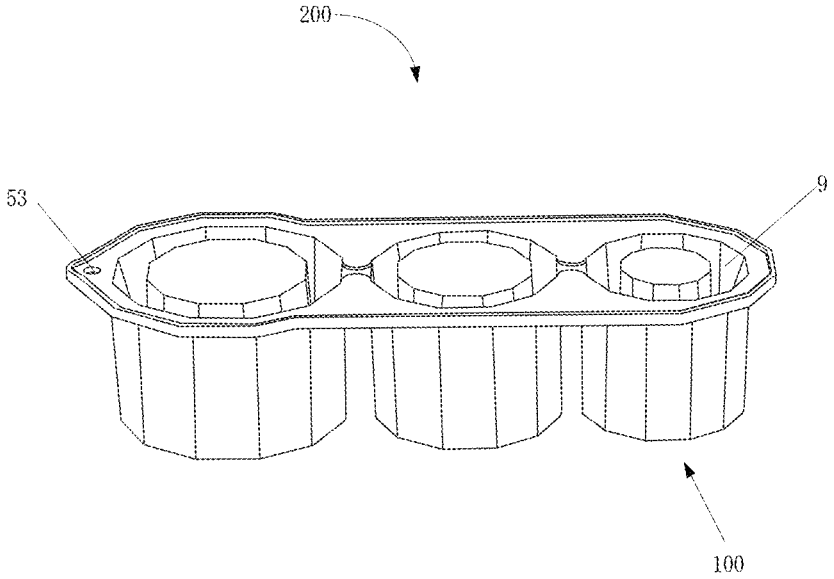
FIG. 13 is a structural schematic view of a mold assembly for preparing sleeve-molded ice blocks according to an Embodiment 4 of the present disclosure.
Figure 14:
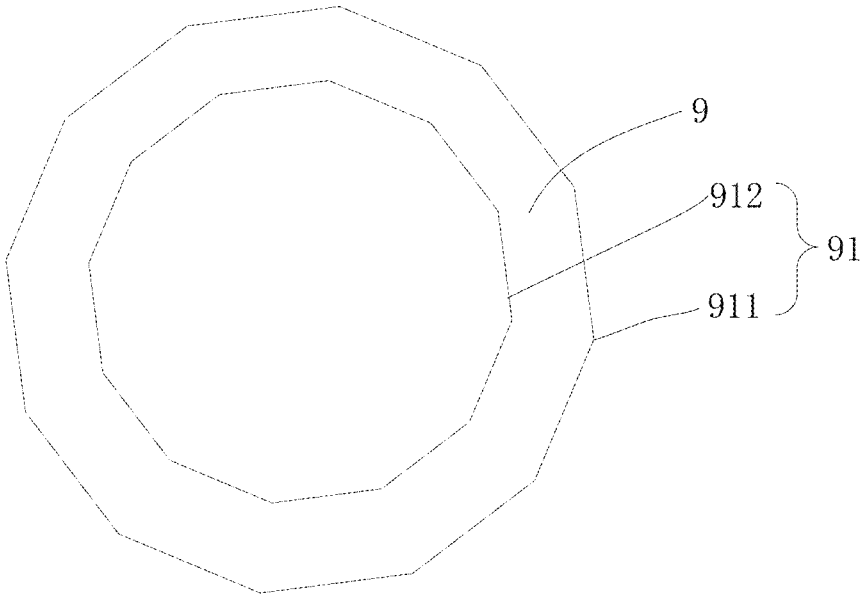
FIG. 14 shows an outer contour and an inner contour of the ring-shaped space of the mold assembly for preparing sleeve-molded ice blocks according to the Embodiment 4 of the present disclosure.

As shown in FIGS. 13 and 14, in the present embodiment, the inner contour line and the outer contour line 91 of a cross section of the ring-shaped space 9 of the mold unit 100 are polygonal. Specifically, the outer contour line 911 and the inner contour line 912 of the cross section of the ring-shaped space 9 of the mold unit 100 are both polygonal. For example, the outer contour line 911 and the inner contour line 912 may be dodecagonal.

In addition, in the present embodiment, the water plate 5 of the mold unit 100 further defines an over-flow hole 53. The over-flow hole 53 is configured to discharge accumulated liquid on the water plate 5 of the mold unit 100.

It is noted that the inner contour lines and the outer contour line 91 of the cross section of the ring-shaped space 9 may be dodecagonal or polygons of other configurations. Cross sections of outer walls and inner walls of the sleeve-molded ice blocks made by this type of configuration are polygonal of other configurations.

Embodiment 5

Figure 15:
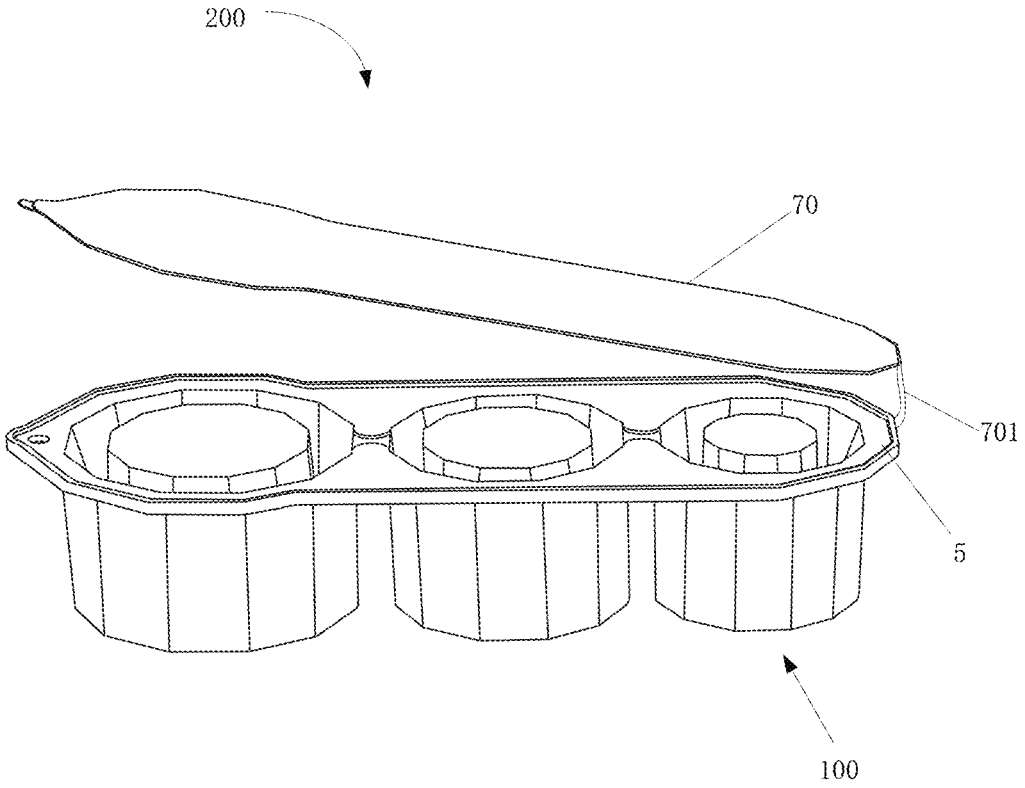
FIG. 15 is a structural schematic view of a mold assembly for preparing sleeve-molded ice blocks according to an Embodiment 5 of the present disclosure.
Figure 16:
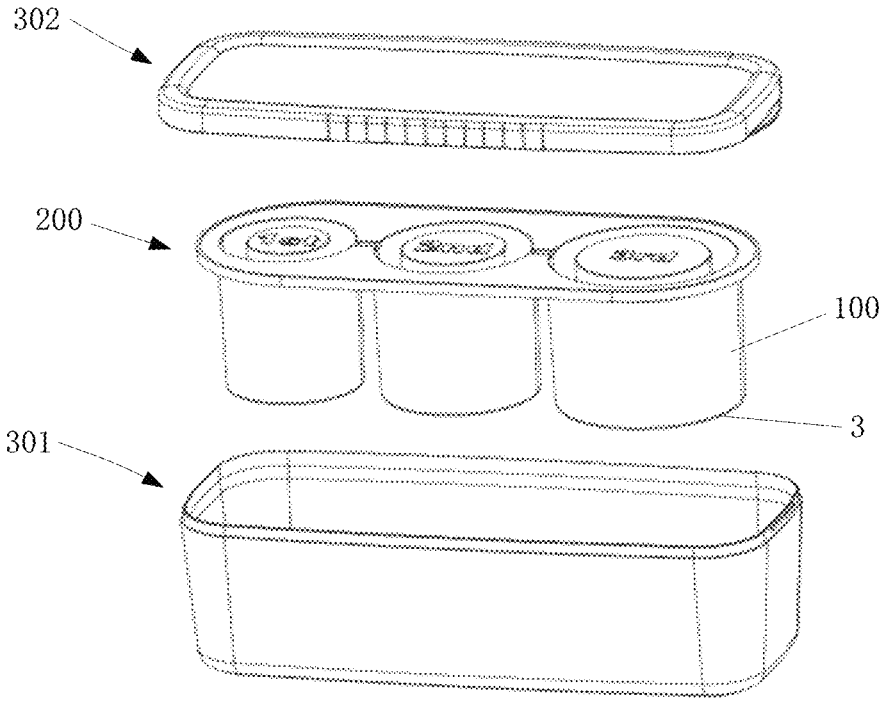
FIG. 16 is an exploded view of a mold box for preparing sleeve-molded ice blocks according to an Embodiment 6 of the present disclosure.
Figure 17:
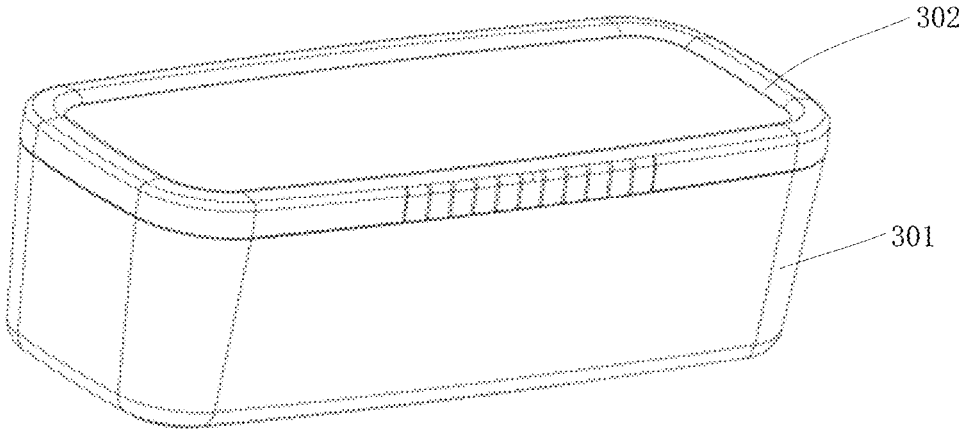
FIG. 17 is a perspective view of an overall configuration of the mold box for preparing sleeve-molded ice blocks according to the Embodiment 6 of the present disclosure.
Figure 18:
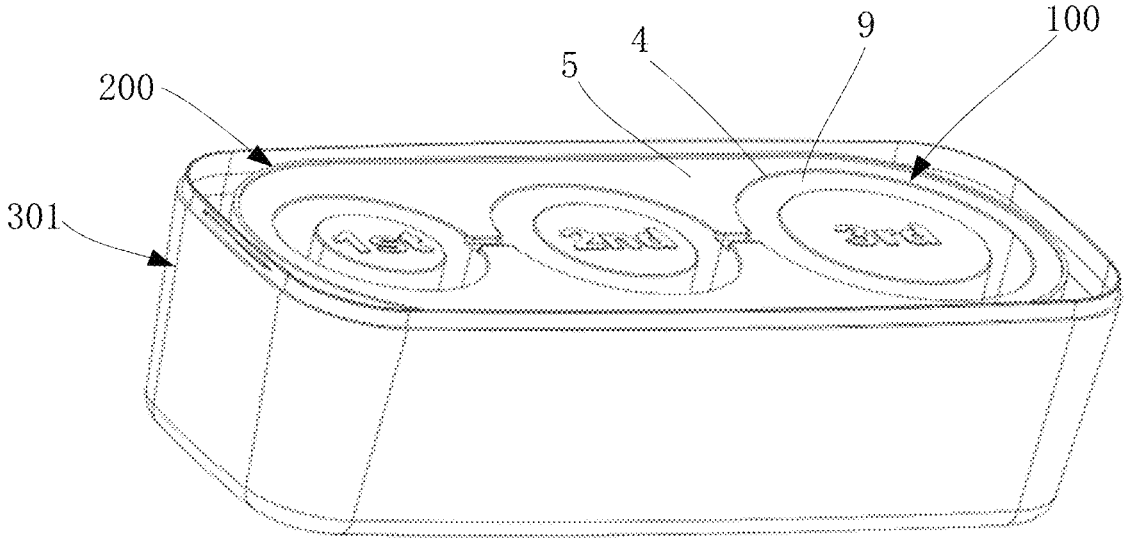
FIG. 18 is a structural schematic view of a box body and the mold assembly of the mold box for preparing sleeve-molded ice blocks according to the Embodiment 6 of the present disclosure.

As shown in FIG. 15, in the present embodiment, the mold assembly 200 for preparing the sleeve-molded ice blocks further includes an upper lid 70. The upper lid 70 completely covers a top of the mold unit 100 to prevent foreign objects from falling into the ring-shaped spaces 9 of the mold assembly 200. In addition, a flexible connection strip 701 is arranged between an edge of the upper lid 70 and an edge of the water plate 5 to facilitate the upper lid 70 to cover or to be released from the water plate 5.

To be noted that, for the mold assembly 200 for preparing the sleeve-molded ice blocks in the present embodiment, the inner contour line and the outer contour line 91 of the cross section of the ring-shaped space 9 of the mold unit 100 may be in other shapes, such as being arc, being elliptical, and so on, in addition to being circle or polygonal. Alternatively, the inner contour line and the outer contour line 91 of the cross section of the ring-shaped space 9 may be configured to have a cartoon shape. In this way, the cross section of the prepared ice block can have the through hole in various shapes, improving the aesthetics of the prepared sleeve-molded ice block.

Embodiment 6

As shown in FIG. 16, FIG. 17, FIG. 18, and FIG. 19, a mold box for preparing sleeve-molded ice blocks includes a box body 301 and a box lid 302. The box body 301 is configured to store the above-described mold assembly 200. The box lid 302 is configured to seal the mold assembly 200 to an interior of the box body 301 and to prevent a foreign object from falling into the mold box.

The box body 301 includes a horizontal box bottom 301*a* and a ring-shaped side wall 301*b*. The horizontal box bottom 301*a* is connected to the ring-shaped side wall 301*b* to form a vessel that does not leak any water. The mold assembly 200 is arranged inside the vessel. The bottom wall 3 of the mold unit 100 of the mold assembly 200 is placed on the horizontal box bottom 301*a* of the box body 301. That is, the bottom wall 3 of the mold unit 100 of the mold assembly 200 abuts against the horizontal box bottom 301*a*. A shape of an opening of the box body 301 is the same as the shape of the water plates 5 that are arranged on the plurality of mold units and are connected to each other. Therefore, an overall of the mold assembly 200 is adapted to the vessel of the box body 301.

A plane on which the opening of the box body 301 is located is substantially parallel to a plane on which the water plates 5 of the plurality of mold units are located, preventing the mold assembly 200 from tilting inside the box body 301 to cause liquid for preparing the ice in the ring-shaped spaces 9 of the mold units 100 to flow out.

Figure 19:
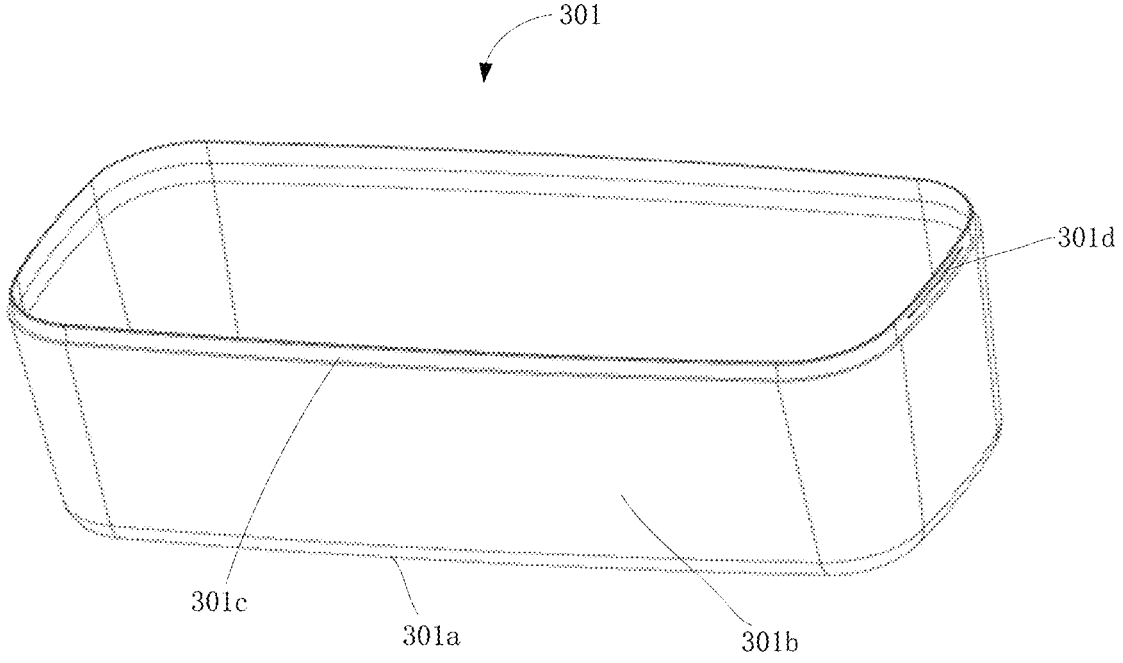
FIG. 19 is a structural schematic view of the box body of the mold box for preparing sleeve-molded ice blocks according to the Embodiment 6 of the present disclosure.
Figure 20:
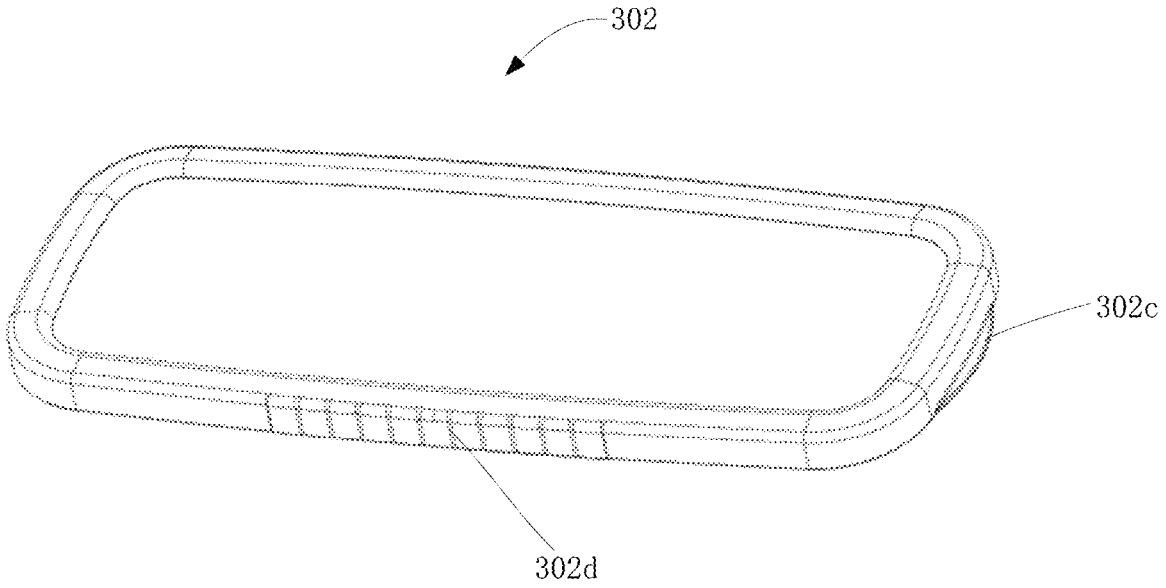
FIG. 20 is a structural schematic view of a box lid of the mold box for preparing sleeve-molded ice blocks according to the Embodiment 6 of the present disclosure.
Figure 21:
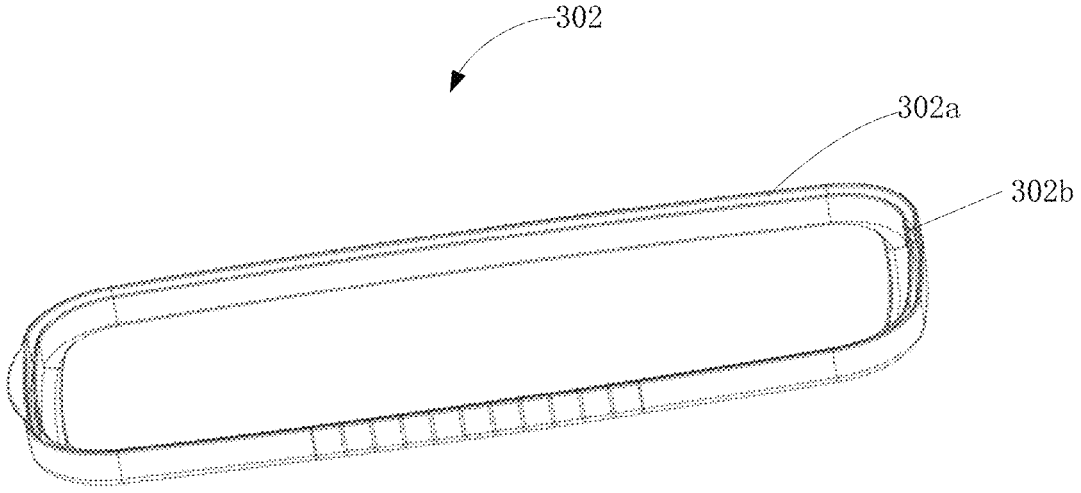
FIG. 21 is a structural schematic view of the box lid, being viewed from another viewing angle, of the mold box for preparing sleeve-molded ice blocks according to the Embodiment 6 of the present disclosure.

As shown in FIGS. 19, 20, and 21, a ring-shaped step edge 301*c* is recessed inwardly and arranged on a top of the ring-shaped side wall 301*b* of the box body 301. The ring-shaped edge of the box lid 302 is double layered and extends downwardly to form a ring-shaped snapping slot 302*a*. The ring-shaped snapping slot 302*a* of the box lid 302 snaps two sides of the ring-shaped step edge 301*c* of the box body 301, achieving seamless snapping between the box lid 302 and the box body 301.

A plurality of outer snapping strips 301*d* are arranged on and protruding outwardly from an outer side of the ring-shaped step edge 301*c* of the box body 301. The plurality of outer snapping strips 301*d* are distributed in a circumferential direction and are spaced apart from each other. A plurality of inner snap strips 302*b* are arranged on and protruding inwardly an inner side of the outer wall of the ring-shaped snapping slot 302*a* of the box lid 302. The plurality of inner snap strips 302*b* are distributed in a circumferential direction and are spaced apart from each other. Circumferential distributed locations of the plurality of outer snapping strips 301*d* are the same as circumferential distributed locations of the plurality of inner snapping strips 302*b*. When achieving the seamless snapping between the box lid 302 and the box body 301, the plurality of outer snapping strips 301*d* and the plurality of inner snapping strips 302*b* allow the box lid 302 and the box body 301 to be snapped with each other more tightly.

As shown in FIG. 20, a gripping plate 302*c*, in a shape of an approximate brim, is arranged at and protruding outwardly from a lower end of the outer wall of the downwardly-extending ring-shaped snapping slot 302*a* of a short side of the box lid 302. When the box lid 302 is to be released from the box body 301, a force is applied to only the gripping plate 302*c*. Therefore, the gripping plate 302*c* is configured to facilitate the box lid 302 to be opened.

As shown in FIG. 21, a plurality of vertical wavy patterns 302*d* are arranged on an outer side of a middle of an outer wall of the downwardly-extending ring-shaped snapping slot 302*a* of two long sides of the box lid 302. When the box lid 302 is to be released from the box body 301, the wavy patterns 302*d* of the box lid 302 can be held by hand, achieving an anti-slip effect.

In the present embodiment, the mold assembly is placed in the box body, and the box lid sealingly covers the box body, preventing dust and other debris from falling into the liquid for preparing the ice in the mold assembly, and ensuring the hygiene of the ice products. The overall configuration of the mold box is simple, and the mold box can be operated easily.

The above description shows only preferred embodiments of the present disclosure, and is not intended to limit the present disclosure. Any modifications, equivalent substitutions, improvements, and so on, made within the spirit and concept of the present disclosure shall be included in the scope of the present disclosure.

What is claimed is:

1. A mold unit for preparing a sleeve-molded ice block, the mold unit comprising:

an outer wall, configured as a ring-shaped enclosure to define an outer peripheral shape of the sleeve-molded ice block;

an inner wall, configured as an inner column to define a through hole in the sleeve-molded ice block;

a bottom wall, disposed between a bottom of the outer wall and a bottom of the inner wall and configured to define a bottom shape of the sleeve-molded ice block; and an opening, disposed at a top of a ring-shaped space defined by the outer wall, the inner wall, and the bottom wall, wherein, liquid for preparing the sleeve-molded ice block is capable of being added through the opening;

wherein a pull-out inclination is formed between the outer wall and the inner wall that define the ring-shaped space, the pull-out inclination is configured to enable the sleeve-molded ice block to be easily taken out of the mold unit.

2. The mold unit according to claim 1, further comprising a water plate arranged at a top of the outer wall, wherein, the water plate is substantially parallel to the bottom wall and is configured to prevent the top of the outer wall from being deformed.

3. The mold unit according to claim 2, further comprising a top plate arranged at a top of the inner wall, wherein, the inner column is hollow having an opening facing downwardly, and the top plate is arranged to prevent the top of the inner wall from being deformed.

4. The mold unit according to claim 3, wherein, a plurality of reinforcing ribs are arranged at an interior of the hollow inner column, and each of plurality of reinforcing ribs comprises:

a radial rib, extending along a rear of the top plate; and a generatrix rib, connecting with the radial rib and extending along a rear of the inner wall.

5. The mold unit according to claim 4, wherein, each of an inner contour line and an outer contour line of a cross section of the ring-shaped space is circular or polygonal.

6. The mold unit according to claim 5, wherein, the outer wall of the ring-shaped space, the inner wall of the ring-shaped space, the bottom wall of the ring-shaped space, the water plate, the top plate, and the plurality of reinforcing ribs are configured as a one-piece and integral structure and are made of silicone.

7. The mold unit according to claim 6, wherein, a reinforcing ring is arranged at connection between a rear of the water plate and the outer wall; and the reinforcing ring is configured to improve resistance of an outer edge of the opening of the mold unit against deformation.

8. A mold assembly for preparing a sleeve-molded ice block, the mold assembly comprising:

a plurality of mold units according to claim 1, wherein, axes of the plurality of mold units are substantially parallel to each other; and water plates of all of the plurality of mold units are connected to form a one-piece structure and are located on a same horizontal plane.

9. The mold assembly according to claim 8, wherein, the plurality of mold units comprises a small-size mold unit, a medium-size mold unit, and a large-size mold unit;

a maximum size of a bottom of a ring-shaped space of the small-size mold unit is larger than a minimum size of a top of the ring-shaped space of the medium-sized mold unit; and a maximum size of a bottom of the ring-shaped space of the medium-sized mold unit is larger than a minimum size of a top of the ring-shaped space of the large-sized mold unit.

10. The mold assembly according to claim 9, wherein, a front side of the water plates, which are connected to each other to form the one-piece structure, defines a communication slot between every two adjacent mold units of the plurality of mold units; and the communication slot is configured to enable liquid for preparing the ice in one ring-shaped space of one of the plurality of mold units to flow to another ring-shaped space of adjacent one of the plurality of mold units for compensation.

11. The mold assembly according to claim 10, wherein, a ring-shaped protruding edge is arranged at a periphery of a front side of the water plates and extends upwardly and downwardly, the ring-shaped protruding edge is configured to increase resistance of an outer edge of the water plates of the mold assembly against deformation.

12. The mold assembly according to claim 11, further comprising an upper lid;

wherein, the upper cover is configured to cover a top of the water plates to prevent foreign objects from falling into the ring-shaped spaces of the mold assembly.

13. The mold assembly according to claim 12, wherein, a flexible connection strip is arranged between an edge of the upper lid and an edge of the water plates to facilitate the upper lid to cover or to be released from the water plates.

14. A mold box for preparing a sleeve-molded ice block, the mold box comprising:

a box body, configured to store the mold assembly according to claim 8;

wherein, a horizontal box bottom and a ring-shaped side wall of the box body are connected to each other to form a vessel that does not leak any liquid;

the bottom wall of the mold unit of the mold assembly is placed on the horizontal box bottom of the box body;

a shape of an opening of the box body is the same as a shape of the water plates that are connected to each other to form the one-piece structure.

15. The mold box according to claim 14, wherein, a plane on which an opening of the box body is located is substantially parallel to a plane on which the one-piece structured water plates is located.

16. The mold box according to claim 14, further comprising:

a box lid, configured to seal the mold assembly to an interior of the box body to prevent a foreign object from falling into the mold box.

17. The mold box according to claim 16, wherein, a ring-shaped step edge is recessed inwardly and arranged on a top of the ring-shaped side wall of the box body;

the ring-shaped edge of the box lid is double layered and extends downwardly to form a ring-shaped snapping slot;

the ring-shaped snapping slot of the box lid snaps two sides of the ring-shaped step edge of the box body to achieve seamless snapping between the box lid and the box body.

18. The mold box according to claim 17, wherein, a plurality of outer snapping strips are arranged on and protruding outwardly from an outer side of the ring-shaped step edge of the box body;

a plurality of inner snap strips are arranged on and protruding inwardly an inner side of an outer wall of the ring-shaped snapping slot of the box lid;

circumferential distributed locations of the plurality of outer snapping strips are the same as circumferential distributed locations of the plurality of inner snapping strips.

19. The mold box according to claim 18, wherein, a gripping plate, in a shape of an approximate brim, is arranged at and protruding outwardly from a lower end of the outer wall of the downwardly-extending ring-shaped snapping slot of a short side of the box lid, the gripping plate is configured to facilitate the box lid to be opened.

* * * * *